US005100146A

United States Patent [19]

Antonious

[11] Patent Number: 5,100,146

[45] Date of Patent: Mar. 31, 1992

[54] PUTTER HEAD WITH SECONDARY WEIGHT MEMBERS ADJACENT HEEL AND TOE PORTIONS OF A CLUB HEAD

[76] Inventor: Anthony J. Antonious, 205 E. Joppa Rd., Towson, Md. 21204

[21] Appl. No.: 365,005

[22] Filed: Jun. 12, 1989

[51] Int. Cl.[5] ..... A63B 53/04

[52] U.S. Cl. ..... 273/167 F; 273/169

[58] Field of Search ..... 273/167-175, 273/77 R, 77 A, 164; D21/217-219

[56] References Cited

U.S. PATENT DOCUMENTS

| | | | |
|---|---|---|---|
| D. 202,715 | 11/1965 | Solheim | 273/167 D X |
| D. 207,227 | 3/1967 | Solheim | 273/167 D X |
| D. 209,761 | 1/1968 | Solheim | 273/167 R X |
| D. 228,930 | 10/1973 | Leigh | 273/167 F X |
| D. 240,948 | 8/1976 | Redoutey | 273/167 A X |
| D. 290,984 | 7/1987 | Antonious | D21/219 |
| D. 291,465 | 8/1987 | Antonious | D21/219 |
| D. 293,809 | 1/1988 | Antonious | D21/219 |
| D. 297,964 | 10/1988 | Shearer | D21/219 |
| 1,139,985 | 5/1915 | Legh | 273/169 |
| 1,671,956 | 5/1928 | Sime | 273/174 |
| 3,042,405 | 7/1962 | Solheim | 273/167 G X |
| 3,966,210 | 6/1976 | Rozmus | 273/169 |
| 4,355,808 | 10/1982 | Jernigan et al. | 273/173 X |
| 4,580,784 | 4/1986 | Brill | 273/162 E |
| 4,693,478 | 9/1987 | Long | 273/164 |
| 4,714,252 | 12/1987 | Roraback | 273/171 |
| 4,747,599 | 5/1988 | Antonious | 273/167 G |
| 4,824,115 | 8/1989 | Walther | 273/169 |
| 4,826,172 | 5/1989 | Antonious | 273/167 H X |

FOREIGN PATENT DOCUMENTS

| | | | |
|---|---|---|---|
| 465652 | 4/1937 | United Kingdom | 273/169 |

OTHER PUBLICATIONS

"The Klunker" as seen in *Golf World* Feb. 8, 1974, p. 24.
"Golf Digest" Magazine (Jun. 1985 issue) p. 32.
"Lynx Putters" as seen in *Golf Digest,* Apr. 1977, p. 34.
"The Inertial Putter" as seen by slotline Golf 1984.
"Long Green Glider" as seen in *Golf World,* May 28, 1976, p. 19.
"Super 1" as seen in *Golf Digest,* Dec. 1976, p. 12.

*Primary Examiner*—Edward M. Coven
*Assistant Examiner*—Sebastiano Passaniti
*Attorney, Agent, or Firm*—N. J. Aquilino

[57] ABSTRACT

A putter type golf club head including a rear cavity defined by heel and toe weights including secondary weights positioned on the top surface of said heel and toe weight masses between said cavity and the extremities of the golf club. The invention contemplates varying the size and height of the secondary weight members to provide precise weight adjustment thereon.

3 Claims, 3 Drawing Sheets

FIG. 4
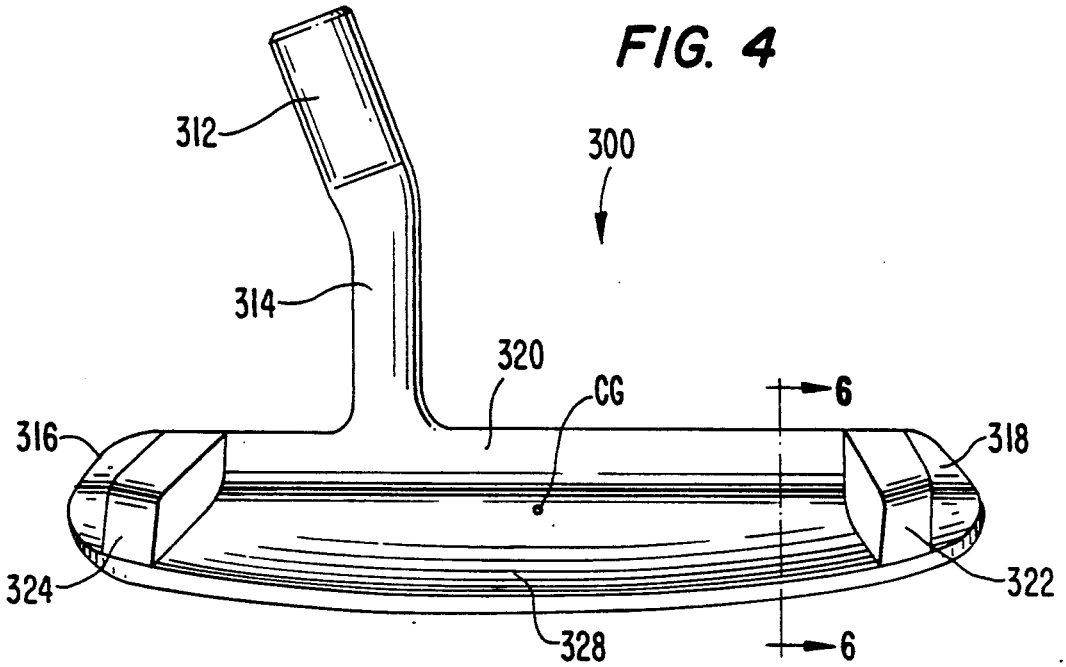
FIG. 5
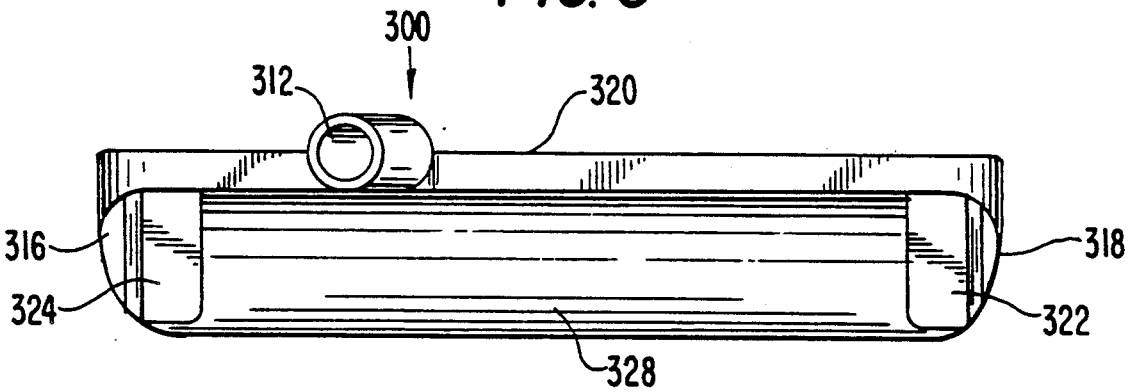
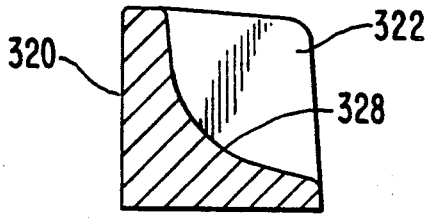
FIG. 6

PUTTER HEAD WITH SECONDARY WEIGHT MEMBERS ADJACENT HEEL AND TOE PORTIONS OF A CLUB HEAD

BACKGROUND OF THE INVENTION

The present invention relates to golf club heads, and more particularly to an improved putter type golf club head having a unique weight configuration.

Putter type golf club heads having various weight configurations to reduce torque and loss of energy when a golf ball is struck off of the center of percussion are well known in the art. For example, most cavity back type putters provide a mass of weight behind the ball striking face at both the heel and toe positions for this purpose. The greater the mass toward the extremity of the golf club, the greater the moment of inertia for that particular structure. Therefore, it follows that a club head with weight toward the toe and heel portions inherently has a high moment of inertia, and the higher the moment of inertia, the less likely the club is to turn when a golf ball is struck off of the center of percussion.

The present invention relates to a cavity back putter type golf club head which includes auxiliary or secondary weights in various widths and heights positioned at the rear of the club head to control the mass weight distribution thereof. In a preferred embodiment, the mass takes the form of upstanding bosses which extend from the upper rear surface of the club head in a vertical direction. Various embodiments are contemplated. Various embodiments include a secondary weight mass located at the extreme ends of the golf club head adjacent the toe and heel areas to further increase the weight away from the center of gravity and the center of percussion to produce its maximum leverage which in turn increases the moment of inertia, and decreases the tendency of the center of percussion for those golfers who prefer a more solid feel when the ball is properly struck.

The invention further contemplates providing secondary weight members which can be variable in size in order to produce optimum balance and control the overall weight distribution of various club head shapes and sizes.

Among the objects of the present invention are the provision of a golf club head using a combination of various sizes and shapes and specifically positioned secondary weight members to control the overall weight distribution and performance of the golf club head.

Other objects and advantages of the invention will be set forth in part in the description which follows, and in part will be obvious from the description, or may be learned by the practice of the invention. Further objects and advantages will be realized with reference to the following specification and accompanying drawings which serve to explain the principles of the invention.

DESCRIPTION OF THE DRAWINGS

FIG. 4 is a rear elevational view of a second embodiment of the putter head of the present invention.

FIG. 5 is a top plan view of the putter head of FIG. 4.

FIG. 6 is a sectional view taken along the lines 6—6 of FIG. 4.

DESCRIPTION OF PREFERRED EMBODIMENTS

Figure 1:
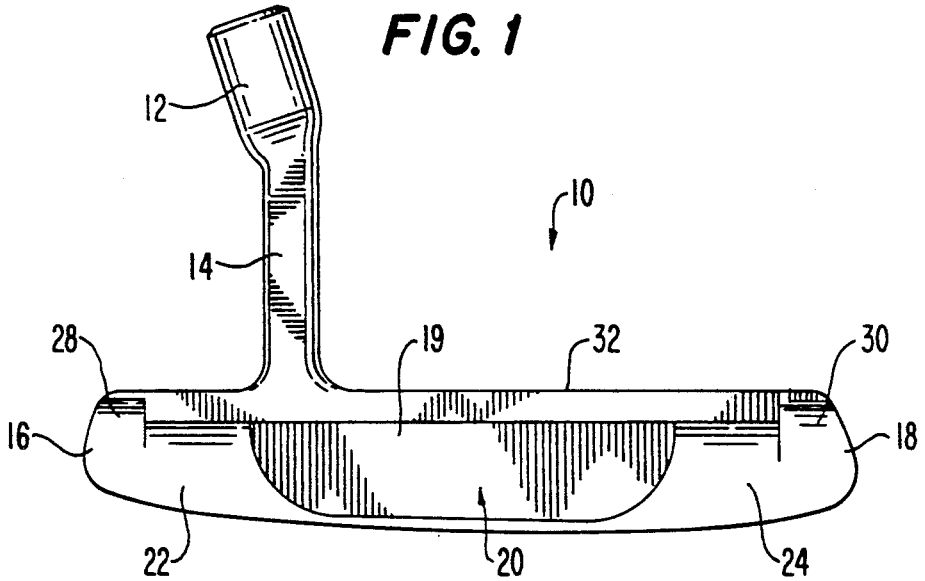
FIG. 1 is a rear elevational view of a first embodiment of putter head of the present invention.

Reference will now be made in detail to the present preferred embodiments of the invention which are illustrated in the accompanying drawings. Wherever possible, the same or similar reference numerals will be used throughout the drawings to refer to the same or like parts.

Figure 2:
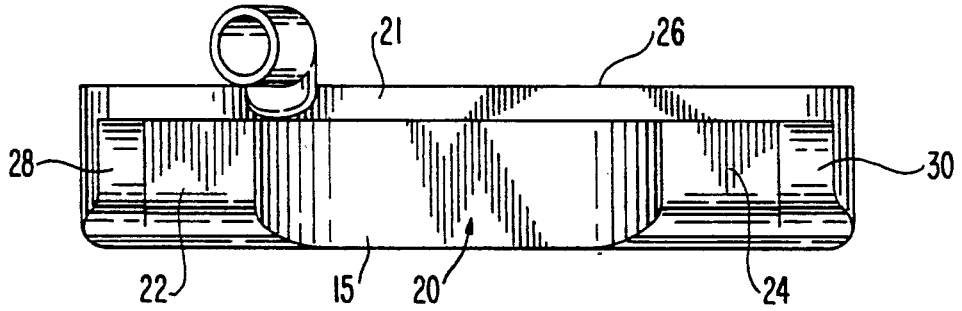
FIG. 2 is a top plan view of the putter head of FIG. 1.
Figure 3:
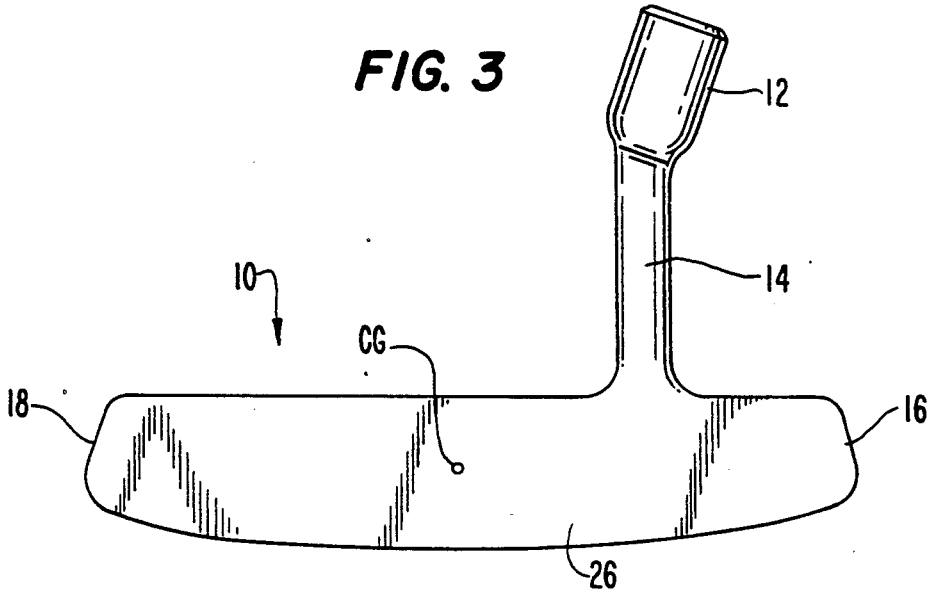
FIG. 3 is a front elevational view of FIG. 1.

FIGS. 1, 2 and 3 illustrate a putter type golf club head 10 including a shaft engaging socket 12, hosel 14, flange 15, heel 16, toe 18, rear face 19, rear cavity 20, rear edge 21 top ridge, 32 heel weight 22 and toe weight 24. The front of the putter head 10 includes a ball striking face 26 having a center of gravity (CG) and a center of percussion (CP) thereon. In this embodiment secondary weight members 28 and 30 are positioned on the heel 16 and toe 18 respectively. The weight members are made in the form of bosses which extend vertically from the top surface of the heel weight 22 and toe weight 24.

For the purpose of this description of the invention, the bosses are further defined as upstanding, generally rectangular elements having flat side walls and a flat upper surface. The base of each of the bosses lies on and is integrally formed with a generally flat upwardly facing rear surface on the club head 10.

It will be appreciated that while the secondary weight members 28 and 30 are shown to extend nearly to the top ridge 32 of the club head 10, the height of each member can be varied, and they equally can be made to extend beyond the top ridge 32. Likewise, the width of each of the secondary weight members 28 and 30 can be varied to increase or decrease the overall weight of the club head.

In this particular embodiment the placement of the secondary weight members 28 and 30 are at the extreme heel 16 and toe 18 positions and at the maximum distance from the center of gravity (CG) or center of percussion located at approximately the same point. This structure creates a high moment of inertia which reduces the tendency of the club head to torque or turn when a golf ball is struck off-center.

FIGS. 4, 5 and 6 show a second embodiment of a club head 300 of the present invention. This embodiment includes a shaft socket 312, hosel 314, heel 316 and toe 318. This embodiment is shown as a blade and flange type putter including a rearwardly extending flange 328 and a ball striking blade 320. Secondary weight members 322 and 324 are vertically positioned on the rear flange 328 adjacent the extreme end of the heel 316 and toe 318. The secondary weight members 322 and 324 act to increase the weight at approximately the extreme ends of the club head for optimum leverage thereby increasing the moment of inertia and providing the club head with more stability for off-center hits.

Figure 7:
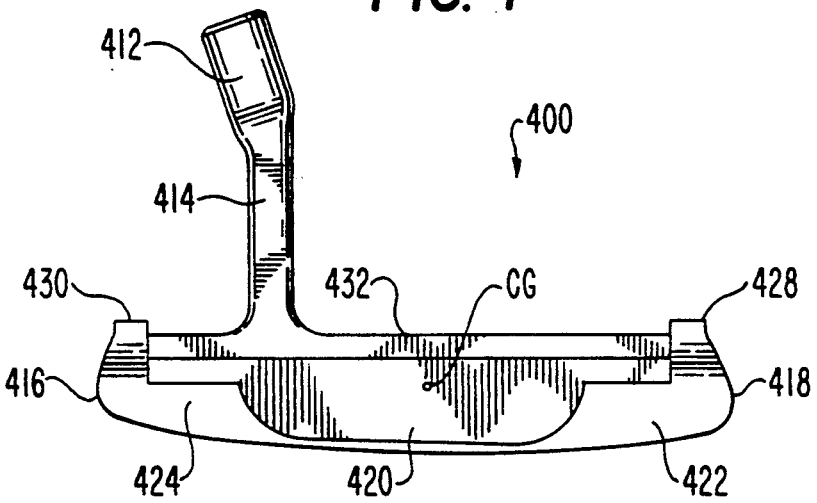
FIG. 7 is a rear elevational view of a third embodiment of the putter head of the present invention.

FIG. 7 illustrates a third embodiment of a golf club head 400 of the present invention which includes a shaft socket 412, hosel 414, heel 416 and toe 418. This embodiment is a cavity back type putter including a cavity 420, toe weight 422 and heel weight 424. The club head also includes a secondary toe weight 428 and a secondary heel weight 430 both of which extend above the top ridge 432 of the club head. The secondary weight members increase the weight not only at the ends of the club, but in a vertical direction above the normal center of gravity (CG) to increase club head stability when a golf ball is struck.

Figure 8:
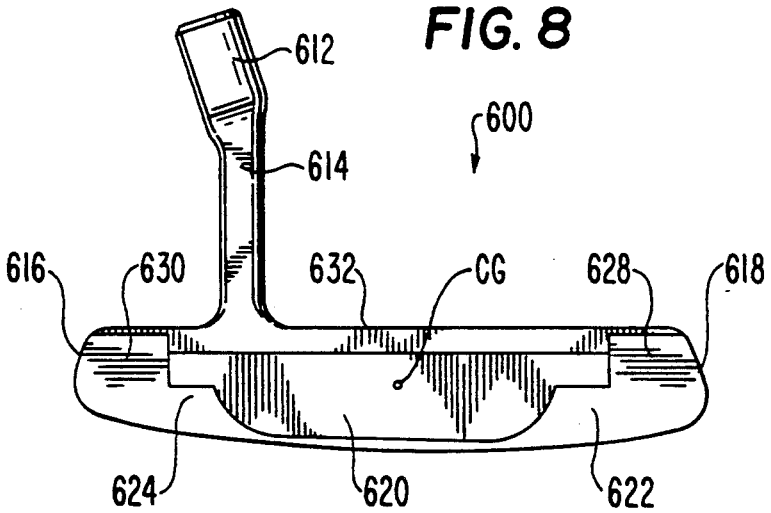
FIG. 8 is a rear elevational view of a fourth embodiment of the putter head of the present invention.

FIG. 8 illustrates a fourth embodiment of a club head 600 of the present invention which includes a shaft socket 612, hosel 614, heel 616 and toe 618. This embodiment is a cavity back type putter including a cavity 620, toe weight 622 and heel weight 624. The club head also includes a secondary toe weight 628 and a secondary heel weight 630 both of which extend upwardly adjacent the top ridge 632 of the club head. The secondary weight members increase the weight not only at the ends of the club, but in a vertical direction above the normal center of gravity (CG) to increase club head stability when a golf ball is struck.

Figure 9:
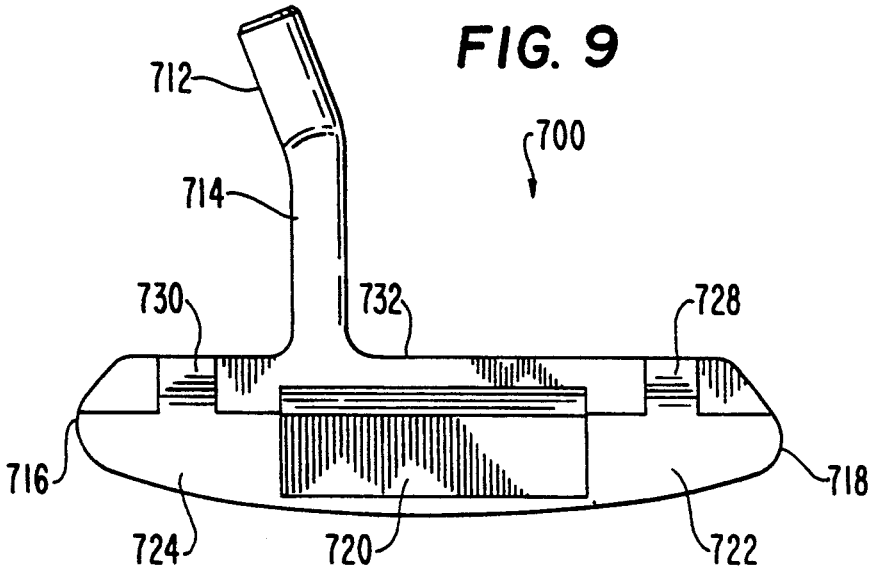
FIG. 9 is a rear elevational view of a fifth embodiment of the putter head of the present invention.

FIG. 9 illustrates a fifth embodiment of a club head 700 of the present invention including a shaft socket 712, hosel 714, heel 716 and toe 718. The club head is formed with a cavity 720, toe weight 722 and heel weight 724. In this embodiment, a secondary toe weight 728 and secondary heel weight 730 are both centrally disposed between the edges of the cavity 720 and the toe 718 and heel 716 respectively on the club head. In this embodiment the top surfaces of the secondary weight members 728 and 730 coincide with the top ridge 732 of the club head.

It will be appreciated that various design changes may be made in the club head design described above without departing from the scope of the present invention as defined in the following claims.

I claim:

1. A putter type golf club head including a shaft socket, hosel and club head body; said body including a heel, toe, top ridge, ball striking face, rear face, a flange extending rearwardly from said rear face and having a rear edge, a heel mass and toe mass located above said flange adjacent said heel and said toe, respectively, and a rear cavity formed on said flange between said heel mass and said toe mass wherein the improvement comprises:

secondary weight masses positioned on and vertically disposed above said heel and toe masses and located at the extreme heel and toe ends of said club head body adjacent said heel and toe respectively, said secondary masses being characterized by upstanding bosses, rectangular in shape and having a longitudinal axis in a direction perpendicular to said ball striking face, said secondary masses providing additional weight to said club head at the extreme heel and toe ends thereof.

2. The putter type golf club head of claim 1 wherein said upstanding bosses include flat side walls and a flat upper surface and a base integrally formed on said heel and toe masses.

3. The putter type golf club head of claim 1 wherein said secondary weight masses extend in a front-to-rear direction from said rear face to said rear edge.

* * * * *